United States Patent [19]

Brennan

[11] 4,014,737

[45] Mar. 29, 1977

[54] METHOD OF MOLDING PREFORM HAVING 600% BY WEIGHT WATER

[76] Inventor: Robert M. Brennan, R.R. 8, Columbia City, Ind. 45725

[22] Filed: May 19, 1975

[21] Appl. No.: 578,933

[52] U.S. Cl. ..... 162/226; 162/227; 162/231

[51] Int. Cl.[2] ..... D21J 3/12

[58] Field of Search ..... 162/226, 227, 228, 231, 162/224, 396, 399; 181/173, 169

[56] References Cited

UNITED STATES PATENTS

| | | | |
|---|---|---|---|
| 1,984,019 | 12/1934 | Hawley | 162/226 X |
| 2,006,831 | 7/1935 | Hawley | 162/226 |
| 2,116,198 | 5/1938 | Hawley | 162/226 X |
| 2,471,932 | 5/1949 | Chaplin | 162/226 X |
| 2,510,595 | 6/1950 | McEwen et al. | 162/78 X |
| 3,813,284 | 5/1974 | Miki et al. | 162/224 X |

*Primary Examiner*—S. Leon Bashore
*Assistant Examiner*—Richard V. Fisher
*Attorney, Agent, or Firm*—Mason, Kolehmainen, Rathburn & Wyss

[57] ABSTRACT

A molded cellulosic article, such as a loudspeaker cone, is formed without an intermediate drying step by first forming a pre-form having 600 – 900% water on a water pervious wire net, inserting the pre-form directly into a hot press, and drying the pre-form to less than about 5% by weight water in the hot press at a pressure less than about 400 psi and at a temperature of 400° – 450° F.

15 Claims, 2 Drawing Figures

METHOD OF MOLDING PREFORM HAVING 600% BY WEIGHT WATER

FIELD OF THE INVENTION

This invention relates to a process for forming cellulosic articles, such as cones for loudspeakers and the like, and more particularly relates to the process of forming a cellulosic fiber structure and drying the structure in a hot press to a substantially bone dry condition while eliminating an intermediate drying step.

PRIOR ART

It is common in forming cellulosic fiber articles, such as loudspeaker cones, to dip a suction mold having a wire net thereon into a pulp slurry and raise the mold while drawing suction therethrough to cause paper fibers suspended in the pulp slurry to be collected on the surface of the wire net to a desired thickness. The wet cellulosic layer formed on the wire net is called a "pre-form". It is further conventional to partially dry the pre-form in an intermediate drying step to about 300% by weight water by drawing air through the pre-form, and then place the partially dryed pre-form and wire net in a heated press at about 10000 psi and 400°–450° F. to dry the preform to substantially bone dry.

In prior art processes, the intermediate partial drying step to dry the pre-form from its initial water content of about 900% by weight to about 300% by weight water was thought essential to achieve sufficient density of the cellulosic article and since in prior art processes the heated press could not allow for the escape of steam generated within the press if the pre-form contained more than about 300% water. With prior art processes, more than about 300% water in the pre-form would cause excessive blistering of the product and sometimes delamination or exploding when the product was removed from the press.

SUMMARY OF THE INVENTION

It has been found, in accordance with the present invention, that the intermediate drying step can be eliminated so that the pre-form, having 600 – 900% by weight water, can be inserted directly into a heated press and dried to substantially bone dry of less than 5% by weight water in one hot press drying step. Surprisingly, it has been found that by inserting the pre-form having about 600 – 900% water between conforming die surfaces of a mold, at a temperature of about 400 – 450° F. and a pressure of less than about 400 psi, the pre-form can be dried from 900% to less than 5% water using only the heated mold. The steam generated within the mold escapes laterally throught the wire net and, possibly, through the cellulosic fibers so that substantially no blistering or delamination of the product occurs. A product having the same caliper and density can be produced in accordance with the present invention in a hot press which can be closed three to six times faster than a press used in conventional processes using an intermediate drying step.

The mechanism for achieving the same caliper and density as prior art processes in the cellulosic product produced according to the process of the present invention including eliminating the intermediate drying step and using much less pressure in the hot press is not completely understood and is indeed quite surprising. Without limiting the invention to any particular theory, it is believed that a pre-form containing at least about 600% water is much more plastic and can be more easily compressed and dried than a pre-form containing only about 300% water. Further, it is theorized that by using longer fibers in making the pre-form, the steam resulting in the hot press can be more easily vented because of decreased freeness of the pre-form and because the porosity of the wire net is not substantially reduced by clogging of short fibers between the wire pores.

An object of the present invention is to provide a method of producing molded cellulosic articles by forming a pre-form having 600 – 900% by weight water and directly drying the pre-form in a heated mold at a temperature in the range of 400 – 450° F. and at a pressure less than about 400 psi.

Another object of the present invention is to provide an improved method of forming molded cellulosic articles including drying a pre-form in a heated press from 900% water to less than about 5% water while allowing for the escape of copious quantities of steam generated within the press.

Another object of the present invention is to provide an improved method of forming cellulosic articles to provide molded cellulosic articles having greater strength, that are easier to dry, and have a greater capability of venting steam from a mold by providing a pulp slurry having at least 50% fibers having a length in excess of 1 mm.

Another object of the present invention is to provide an improved, more efficient, less time-consuming method of producing molded cellulosic articles by using a water-pervious wire support on which a cellulosic pre-form is formed as a means for venting steam from a heated press used to dry and set the cellulosic product to its final shape.

Another object of the present invention is to provide an improved method of producing cellulosic molded articles including drying a pre-form disposed on a pervious wire net and containing water in excess of 600% by weight in a heated press maintained at a pressure and for a period of time sufficient to remove substantially all of the water contained in the pre-form but insufficient to press the cellulosic fibers through the wire net, so that steam generated in the press can laterally escape therefrom by passage through the pores in the wire net.

In brief, the above and other objects and advantages of the present invention are achieved by forming a pre-form having at least 600% by weight water on a water pervious wire net, disposing the wire net, having the wet pre-form thereon, onto a die surface of a mold, and hot pressing the pre-form, supported on the wire net, at a temperature in the range of about 400° – 450° F. and at a pressure less than 400 psi, preferably 150 psi, until the water content of the pre-form has been reduced to less than about 5% by weight. In this manner, the total time for pressing and drying, including opening and closing the mold, is reduced to about 3.6 seconds.

DETAILED DESCRIPTION OF THE INVENTION

Figure 1:
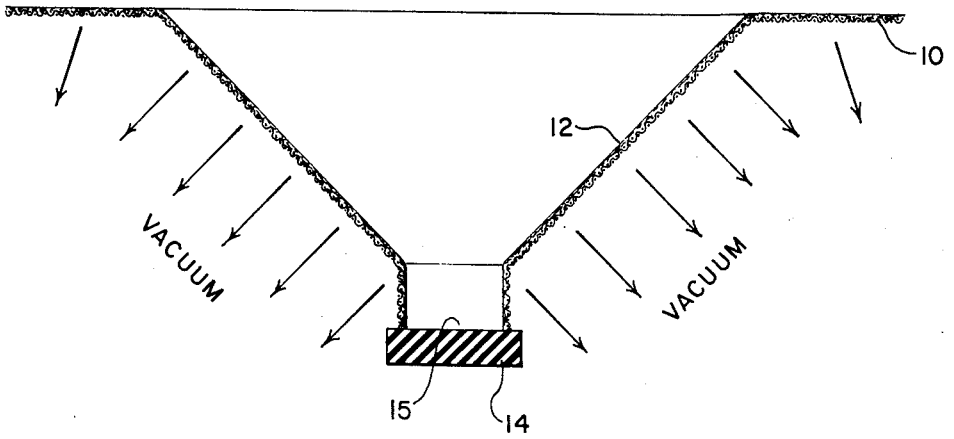
FIG. 1 is a side view of a pervious wire net having a pre-form on its inner surface collected from a pulp slurry.
Figure 2:
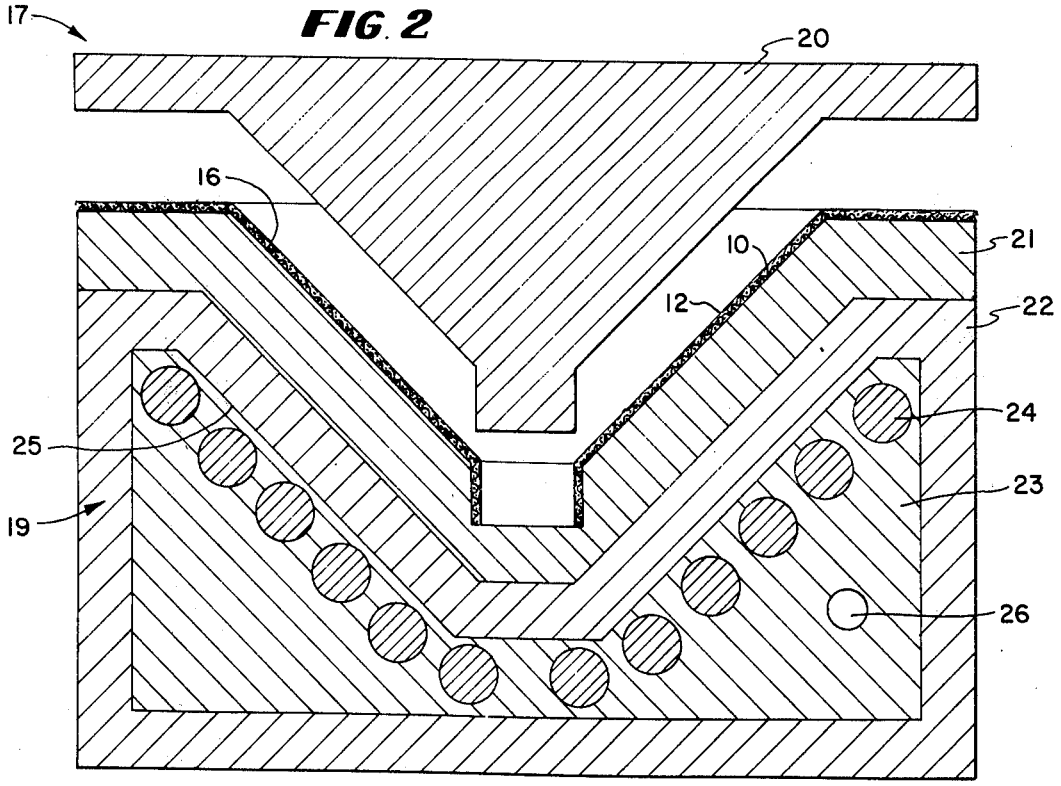
FIG. 2 is a cut-away side view of an open heated mold constructed in accordance with the present invention, and having the pre-form and wire net of FIG. 1 inserted therein, prior to pressing.

Referring now to the drawing and initially to FIG. 1, a pre-form containing 600 – 900% by weight water is formed by inserting a wire net 10 into a water suspension of cellulosic fibers (not shown) and drawing a vacuum of about 18 to 24 inches of mercury through the wire net 10 to thereby collect a pre-form 12 on the inner surface of the wire net 10. A vacuum mold which supports the wire net 10 is not shown in the drawing but is conventional in the art and is used to draw vacuum through the wire net 10 in forming the pre-form 12 having approximately 900% by weight water and having a thickness of about 24 mm. The wire net 10 is shaped to substantially conform to the final desired shape of the cellulosic article as shown in FIGS. 1 and 2. A rubber plug 14 is connected around an annular bottom portion of the wire net 10 during formation of pre-form 12 so that fibers are not drawn through a central annular aperture 15 in wire net 10. In this manner the vacuum can be fully utilized in drawing cellulosic fibers onto the interior surface of wire net 10 to form a pre-form 12 of substantially identical shape to the final dried article. After the cellulosic fibers have been drawn onto the wire net 10 to form the pre-form 12 having 600 – 900% by weight water and a desired thickness of about 24 mm, the pre-form 12 and wire net 10 are removed from the cellulosic fiber suspension, the plug 14 is removed from the wire net 10, and the pre-form 12, together with wire net 10, is inserted onto a heated female die surface 16 of a hot press, shown in FIG. 2 and indicated generally by the reference numeral 19.

It is an important feature of the present invention that the pulp slurry used in forming pre-form 12 contain at least 50% cellulosic fibers having a length in excess of 1 mm. In order to obtain the full advantage of the present invention, the pulp slurry should contain at least 70% cellulosic fibers having a length in excess of 1 mm. The controlled refining of cellulosic fibers to achieve fibers in excess of 1 mm. is well known in the art and need not be described within this specification.

A number of advantages are achieved in the practice of the improved process of the present invention by using at least 50% cellulosic fibers having a length greater than 1 mm. The pre-form 12, because of the longer fibers, has a lower freeness than pre-forms formed by conventional processes using shorter fibers. The pre-form 12 formed in accordance with the process of the present invention is more readily dried within the hot press 17. Without limiting the invention to any particular theory, it is believed that the longer fibers contained in the pre-form having greater than 600% by weight water provide an additional passage between the hot press due surfaces for venting the steam formed in the hot press. In addition, the longer fibers provide a stronger final product at the same caliper and density although much less pressure is used in hot-pressing.

Referring now more particularly to FIG. 2, the hot press or mold 17 includes a female die 19 and a conforming male die 20 for hot pressing and drying pre-form 12 while supported on the wire net 10, as shown in FIG. 2. The female die 19 includes an upper cast iron poriton 21 having an upper surface 16 for supporting the wire net 10 and pre-form 12 during the pressing and the drying operation. The female die 19 further includes an intermediate cast iron layer 22 and a central cast aluminum layer 23 having heating elements 24 embedded therein.

In accordance with an important feature of the present invention, the heating elements 24 are disposed close to an upper surface 25 of the intermediate cast aluminum layer 22 of female die 19. Heating elements can be provided in male die 17 in a like manner. It has been found that to achieve the full advantage of the present invention when the pre-form 12 has in excess of 600% by weight water, that the heating elements 24 should be disposed in a configuration substantially equidistant from the walls of the pre-form 12 within the mold so that the heat transferred from the heating elements 24 to the pre-form 12 is uniformly distributed to the pre-form 12. Heating elements (not shown) in male die should also generally conform to the shape of pre-form 12. Further, the heating elements 24 should be as close as structurally possible to the upper surface 25 of the intermediate cast aluminum layer 22 to achieve maximum heat transfer from heating elements 24 to pre-form 12. Further, in accordance with the present invention, a thermocouple 26 is disposed within the central cast aluminum section 22 containing the heating elements 24 to achieve more accurate temperature control within the mold. In this manner, a pre-form containing 600 – 900% by weight water can be completely and efficiently dried by contacting the male die surface 20 on the surface of pre-form 12 and thereby exerting a pressure less than about 400 psi to reduce the caliper of the pre-form 12 from about 24 mils to about 12 mils and to reduce the moisture content of the pre-form 12 to less than about 5% water and, preferably, to substantially 0% water. In this connection, it is noted that the male die 20 is also heated to approximately the same temperature as the female die 19 by means of elements similar to the elements 24 and 26 of the female die 19 (not shown in the drawing).

It is an important feature of the present invention that the pressure exerted on the pre-form 12 between the dies 19 and 20 of mold 17 cannot be so great that the cellulosic fibers of pre-form 12 are forced downwardly into the wire net 10 to such an extent that steam venting through wire net 10 is substantially retarded. The mold pressure can vary depending upon the percentage of fibers having a length in excess of 1 mm and depending upon the water content of pre-form 12 between 600 and 900% by weight. It is easy to determine the maximum pressure allowable with any particular pre-form by inserting the preform onto the upper surface 16 of female die 19, heated to 400°– 450° F., and compressing male die 20 onto pre-form 12 to a desired pressure for a total press time of about 4 seconds, including opening and closing of the press. When the press is opened, the pre-form 12 should contain less than about 5% water and should not be blistered or delaminated if a workable pressure has been employed.

Generally, the pressure should not exceed about 400 psi and it is preferred to use about 150 psi to dry pre-form 12 within mold 17. The pre-form can be pressed, for example, at a pressure in the range of 100–350 psi. If too much pressure is used, the steam resulting from the vaporization of the water content in pre-form 12 within the mold 17 will not be able to escape from between the dies and will therefore cause delamination and/or blistering of the product which will be readily apparent when the dies are separated.

It has been found in accordance with the process of the present invention that the mold can be closed three to six times more quickly in drying pre-form 12 within mold 17 when a preform containing 600 – 900% water and cellulosic fibers at least 70% of which have a length in excess of 1 mm. By closing the mold three to six times faster and being able to use a pressure of only about 150 psi as opposed to the prior art pressure of about 1000 psi, and further by eliminating the intermediate partial drying step, substantial power savings and economic benefits are achieved in producing a cellulosic article having the same caliper and equal or better density and strength than prior art molded cellulosic articles. Further, in prior art processes it was the pressing operation which was the bottleneck in speed of production of molded cellulosic articles since the press step required more time than forming the pre-form or the partial drying step. The partial dryin step required about 6 – 9 seconds and the total time in the heated press was about 10 seconds. In accordance with the improved process of the present invention, the hot pressing operation, including closing and opening of the mold, for completely drying the cellulosic article, requires only about 3.6 seconds. In accordance with the process of the present invention, therefore, equivalent molded cellulosic articles can be produced in much less time and with much less energy required.

While there has been illustrated and described a single embodiment of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A method of forming a molded cellulosic article comprising forming a pre-form comprising a wet layer of cellulosic fibers, having at least about 600% by weight water, on a water-pervious wire net by contacting the wire net with a water slurry of cellulosic fibers and drawing the fibers onto the wire net by suction through said wire net.

disposing the pre-form having at least about 600% by weight, while water on said wire net, onto a first die surface of a mold, contacting the pre-form, having at least about 600% by weight water, with a second die surface of said mold, and drying the pre-form having at least about 600% by weight water to less than about 5% by weight water in a heated press by pressing said wet layer of cellulosic fibers on said wire net in said heated press between said die surfaces at a pressure less than about 400 p.s.i., while allowing resulting steam to escape from said mold through said wire net and through said cellulosic fibers.

2. A method as defined in claim 1 wherein at least one of the mold die surfaces is heated to a temperature of 400°–450° F.

3. A method as defined in claim 2 wherein the pre-form is pressed at a pressure of 100 – 350 psi.

4. A method as defined in claim 3 wherein the pre-form is pressed at a pressure of about 150 psi.

5. A method as defined in claim 1 wherein the wet layer of cellulosic fibers contains at least 50% fibers having a length in excess of 1.0 mm.

6. A method as defined in claim 5 wherein the pulp slurry contains more than 70% fibers having a length in excess of 1.0 mm.

7. A method as defined in claim 1 wherein the wire net is shaped to substantially conform to the shape of the dryed, molded cellulosic article.

8. A method as defined in claim 7 wherein the wire net forms the shape of a vibration plate for a loudspeaker.

9. A method of forming a molded cellulosic article comprising forming a pre-form comprising a wet layer of cellulosic fibers, having at least 600% by weight water, on a water-pervious support means by contacting the support means with a water slurry of cellulosic fibers and drawing the fibers onto the support by suction through said water-pervious support;

disposing the pre-form comprising cellulosic fibers having at least 600% by weight water while on the water-pervious support means, onto a first die surface of a mold, contacting the pre-form comprising cellulosic fibes having at least 600% by weight water on said water-pervious support means, with a second die surface of said mold, and heating at least one of said die surfaces and pressing said wet layer of cellulosic fibers, having at least 600% by weight water, between said die surfaces at a pressure less than about 400 psi, while allowing resulting steam to escape from said mold through said water-pervious support means, to substantially dry said cellulosic fibers.

10. A method as defined in claim 9 including heating at least one of the mold die surfaces to a temperature in the range of about 400°–450° F.

11. A method as defined in claim 9 including pressing the pre-form at a pressure in the range of about 100–350 psi.

12. A method as defined in claim 9 wherein the wet layer of cellulosic fibers comprises more than 50% fibers having a length in excess of 1.0 mm.

13. A method as defined in claim 12 wherein the wet layer of cellulosic fibers comprises more than 70% fibers having a length in excess of 1.0 mm.

14. A method as defined in claim 9 wherein the water-pervious support means forms the shape of a vibration plate for a loudspeaker.

15. A method of forming a molded article comprising forming a pre-form comprising a wet layer of cellulosic fibers, having at least 600% by weight water and having at least 50% fibers with a length of at least 1.0 mm., on a water-pervious support member;

disposing the pre-form and support member onto a first die surface of a mold, while the pre-form contains at least 600% by weight water and at least 50% fibers with a length of at least 1.0 mm.;

contacting the pre-form of cellulosic fibers, having at least 600% by weight water and having at least 50% fibers with a length of at least 1.0 mm., with a second die surface of said mold, and drying the pre-form of cellulosic fibers, having at least 600% by weight water and having at least 50% fibers with a length of at least 1.0 mm., in a heated press maintained at a pressure and for a period of time sufficient to remove substantially all of the water contained in the pre-form but insufficient to press the cellulosic fibers through the support member, such that steam generated in the heated press can laterally escape therefrom.

* * * * *

UNITED STATES PATENT OFFICE

CERTIFICATE OF CORRECTION

Patent No. 4,014,737 Dated March 29, 1977

Inventor(s) Robert M. Brennan

It is certified that error appears in the above-identified patent and that said Letters Patent are hereby corrected as shown below:

Column 5, line 45, the period (.) should read a comma (,);
line 47, "weight, while water" should read --weight water, while--;
Column 6, line 18, after "water" insert a comma (,);
line 21, "fibes" should read --fibers--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*